US005630254A

United States Patent [19]

Hengst et al.

[11] Patent Number: 5,630,254

[45] Date of Patent: May 20, 1997

[54] SUSPENSION LUG AND LOCKING ELEMENT FOR A CARRYING STRAP

[75] Inventors: Alfred Hengst, Lahnau; Ernst Ruehl, Wetzlar, both of Germany

[73] Assignee: Leica Camera GmbH, Solms, Germany

[21] Appl. No.: 402,044

[22] Filed: Mar. 10, 1995

[30] Foreign Application Priority Data

Mar. 10, 1994 [DE] Germany ..... 44 07 990.7

[51] Int. Cl.[6] ..... A44B 21/00

[52] U.S. Cl. ..... 24/265 AL; 224/614

[58] Field of Search ..... 224/202, 912, 224/614; 24/265 R, 265 A, 265 BC, 265 EC, 265 H, 265 AL, 195, 163 R, 168, 302

[56] References Cited

U.S. PATENT DOCUMENTS

| | | | |
|---|---|---|---|
| Re. 3,216 | 12/1868 | Anderson | 24/265 AL |
| 1,958,911 | 5/1934 | Christoffersen | 24/265 AL |
| 2,539,272 | 1/1951 | Richman | 24/265 R X |
| 4,959,891 | 10/1990 | Chou | 24/265 A |

FOREIGN PATENT DOCUMENTS

| | | | |
|---|---|---|---|
| 454597 | 7/1913 | France | 24/302 |
| 550220 | 4/1932 | Germany | 24/265 EC |
| 3027818 | 2/1982 | Germany . | |

*Primary Examiner*—James R. Brittain
*Attorney, Agent, or Firm*—Foley & Lardner

[57] ABSTRACT

A carrying strap having a suspension lug which is attached at one end in a loop of the strap, is in the shape of a U and includes in the part of the lug lying in the loop, two open legs bent symmetrically at right angles to each other. The legs lie opposite each other in different parallel planes and overlap at a predetermined distance (14). The end of the legs are bent off toward the loop. The carrying strap also includes a locking element which can be pushed over the loop and the leg ends of the suspension lug.

The locking element (12) includes in its upper part, two rectangular slot openings (16, 16'), with a separating web (17) there between and lying in the loop (15). The locking element also includes in its lower part, a rectangular opening (18) for receiving the legs (13, 13') of the suspension lug (10) which are enclosed by the carrying strap (11).

13 Claims, 3 Drawing Sheets

SUSPENSION LUG AND LOCKING ELEMENT FOR A CARRYING STRAP

BACKGROUND OF THE INVENTION

1. Field of the Invention

The present invention relates to carrying straps, particularly to carrying straps having a suspension lug and a locking element.

2. Description of Related Art

German Patent 3,027,818 discloses a carrying strap securing means for detachably fastening a carrying belt having a loop at the end, such as the carrying belt on a camera. The securing means has a locking slide surrounding the carrying belt and a carrier which is made of metal. The carrier has two S-shaped carrying portions turned toward each other with outwardly facing lower sections. The lower sections extend as a base for supporting the loop in a straight transverse line with respect to the longitudinal axis of the strap. The lower sections are connected to an arcuate lug portion. The loop of the carrying strap encloses the base and the arcuate lug part protruding out of the loop. The S-shaped carrying portions lie in a plane and are contained completely in the loop.

The locking slide, which encloses the carrying strap loop for locking, covers the S-shaped carrying portions. The sliding movement is limited by butting against the base. The locking slide has on its inner narrow side a depression or similarly acting cams, into which the outwardly directed, resilient lower sections of the S-shaped carrying portions can engage. The resulting securing of the locking slide can be released relatively easily, which can result in the locking slide sliding back unintentionally on the loop and exposing the carrier. In this situation, the loop can slip out of the exposed carrying portions of the carrier which can result in the suspended object falling out. After the removal of the suspension lug, the locking slide can also run unhindered over the loop and be lost.

SUMMARY OF THE INVENTION

One object of the present invention is to provide a suspension lug and locking slide which are designed to provide increased security against unintentional release without making handling more difficult.

Another object of the present invention is to provide a combination suspension lug and locking element. Still another object of the present invention is to provide a carrying strap securing means which includes a carrying strap, at least one suspension lug and at least one locking element.

In accomplishing the foregoing objects of the present invention, there has been provided according to one aspect of the present invention, a combination suspension lug and locking element adapted for retaining a carrying strap. The combination includes an approximately U-shaped suspension lug. The suspension lug includes an open leg located on an end of each prong of the U-shape. The open legs are bent inward at substantially right angles with respect to said prongs of the U-shape. The legs face each other and are substantially parallel and coextensive for at least a portion of their respective lengths and are separated by a distance. The legs are adapted to be retained in a loop of the carrying strap.

The combination further includes a locking element having an upper part. The upper part includes two substantially rectangular slot openings, with a separating web positioned therebetween. The separating web is adapted to be retained in a loop of the carrying strap. The locking element further includes a lower part which includes a substantially rectangular cross-section lower opening in a bottom wall of the locking element. The rectangular opening is adapted to receive the legs of the suspension lug, when the legs are retained in the loop of the carrying strap. The locking element is adapted to be pushed over the loop of the carrying strap and the legs of the suspension lug to lockingly engage the carrying strap and suspension lug.

Another aspect of the present invention provides a carrying strap securing means which includes a carrying strap, at least one suspension lug as described above, and at least one locking element as described above.

Further objects, features and advantages of the present invention will become apparent from the detailed description of the preferred embodiments which follows.

DETAILED DESCRIPTION OF THE PREFERRED EMBODIMENTS

Figure 1A:
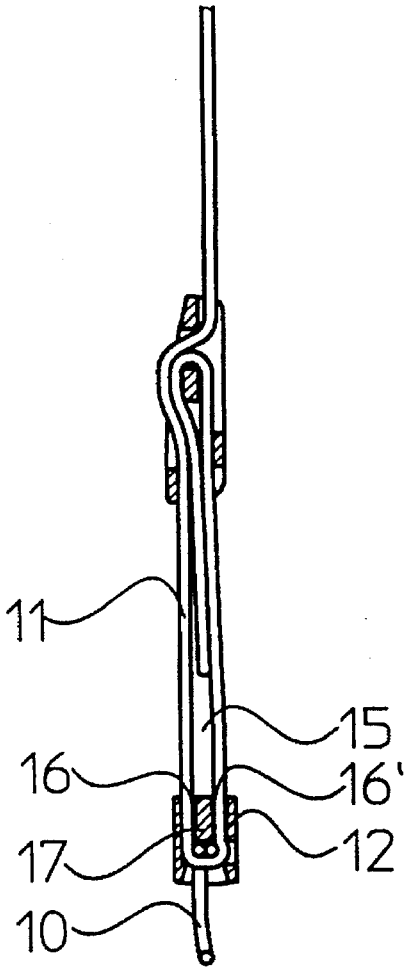
FIGS. 1A and 1B show an end part of a carrying strap in two views.

The present invention comprises an approximately U-shaped suspension lug having legs located on the ends of each prong of the U-shape which are bent at right angles to each other. The legs lie opposite each other in different overlapping planes at a distance apart. In other words, the legs face each other (i.e., extend toward the centerline of the U-shape) and are substantially parallel and coextensive. A locking element is also provided which includes its upper part (i.e., the part in a direction away from the suspending lug), two rectangular slot openings, with a separating web which lies in the loop of the carrying strap. The locking element includes in its lower part, a lower opening having a substantially rectangular cross-section for receiving the legs of the suspension lug, which are enclosed by the carrying strap.

The locking element is captive due to the separating web enclosed by the loop. The legs which overlap each other in different planes at a distance, permit an additional clamping action of the locking slide.

In a preferred embodiment, the mutually overlapping legs are resiliently formed and the lower opening of the locking element is sufficiently narrow such that the overlapping legs are pressed together when the locking element is pushed on onto the suspending lug. This embodiment effects the clamping of the two legs in the lower opening of the locking element.

In a preferred embodiment, the transverse length between the leg ends is longer than the overall dimension of the body of the suspension lug. If the legs are angled off or bent in a direction toward the loop, the length still remains slightly larger than the outside dimension of the outer edge of the suspension lug. This preferred configuration simultaneously provides guidance for the suspension lug, by the clamping in the transverse direction of the lug and the abutment of the suspension lug in the locking element. This feature is described more fully below.

In another preferred embodiment, the lower opening of the locking element may be designed such that it tapers conically toward the loop and is offset parallel to the legs of the suspension lug toward the outer wall. This feature provides further clamping and locking of the suspension lug with the loop in the locking element.

In still another preferred embodiment, the locking element provides in the upper part, recesses for receiving the angled-off leg ends. The recesses are extensions of the lower opening and are located on both sides of the separating web. These recesses serve in interaction with the leg ends of the suspension lug for limiting the downward movement of the locking element.

As described above, the combined width of the recesses and separating web is preferably slightly smaller than the outer edge of the suspension lug in the region of the angling-off of the leg ends. This feature provides further clamping of the suspension lug in the transverse direction of the lug.

In another preferred embodiment, the locking element contains in at least one of its side walls (i.e., the face which lies parallel to the carrying strap), a slot which corresponds to the width of the carrying strap and which faces the inner space of the locking element. With this feature, the carrying strap can protrude into the slot, which effects an additional engaging action.

The locking element is preferably produced as an injection molding.

An exemplary embodiment of the carrying strap according to the invention is represented diagrammatically in and described in more detail with reference to the FIGS. 1–3.

Figure 1B:
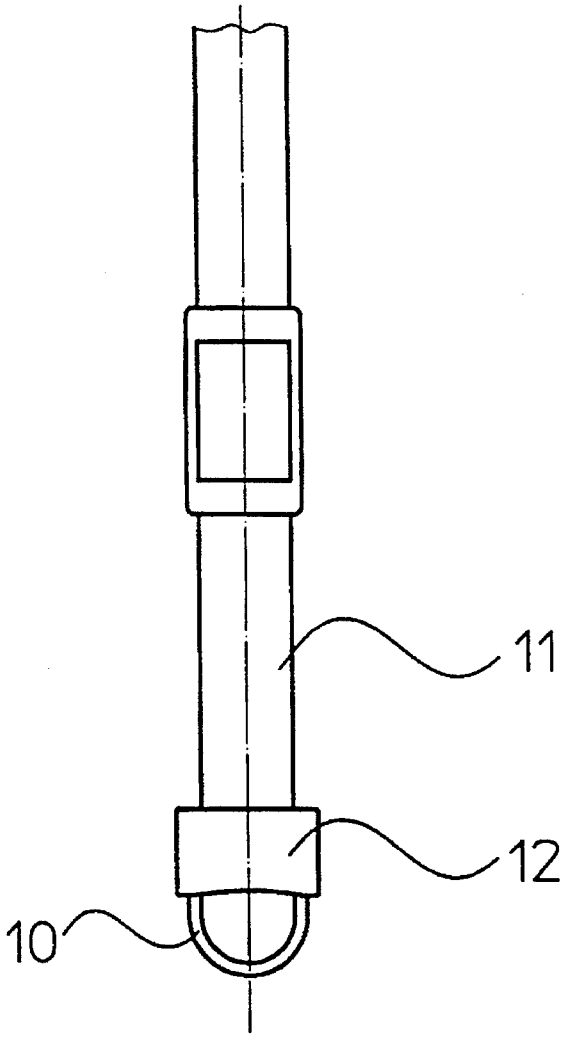
Figure 2A:
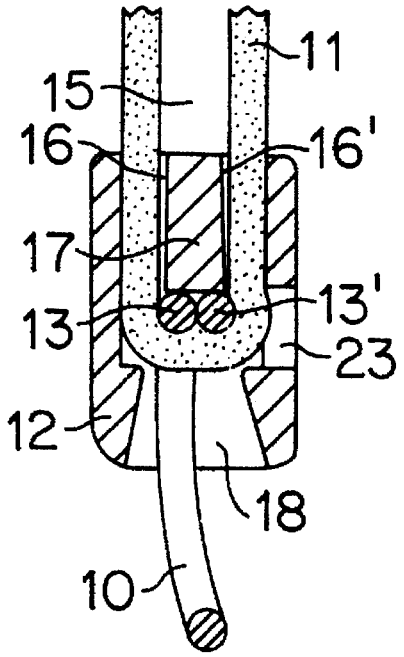
FIGS. 2A and 2B show details from FIGS. 1A and 1B.
Figure 3A:
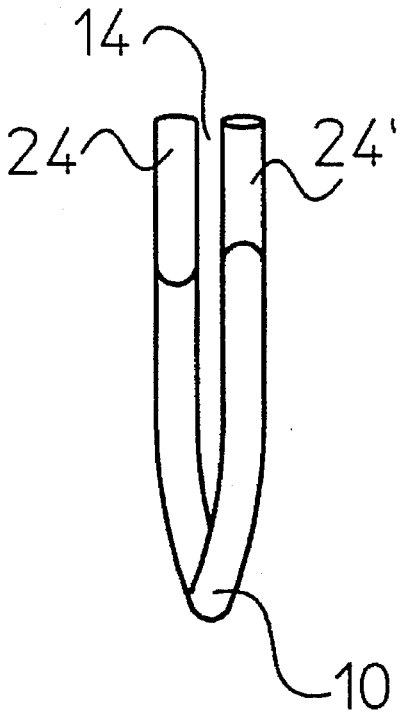
FIGS. 3A and 3B show the suspension lug in the unfitted state in two views.

A carrying strap 11 as shown in FIG. 1, preferably has at both its ends, a suspension lug 10 and in each case a clamping or locking element 12. FIGS. 1*a*, 1*b* show only one end. In the unlocked state, the locking element 12 can be freely moved up and down in the loop 15 of the carrying strap because of the slot openings 16, 16'. The separating web 17 prevents the locking element 12 from sliding out of the loop 15. The suspension lug 10 can be turned freely in the loop 15, as long as the locking element is pushed up. The suspension lug 10 is advantageously produced from resilient material and exhibits between its legs 13, 13' a distance 14, as shown in FIG. 3*a*. This distance 14 permits the threading of one of the leg ends 24, 24' into a securing means, such as a securing strap of a camera. A turning of the suspension lug 10 through 180° completes the threading operation, with the lug always remaining in the loop 15 of the carrying strap 11.

Figure 2B:
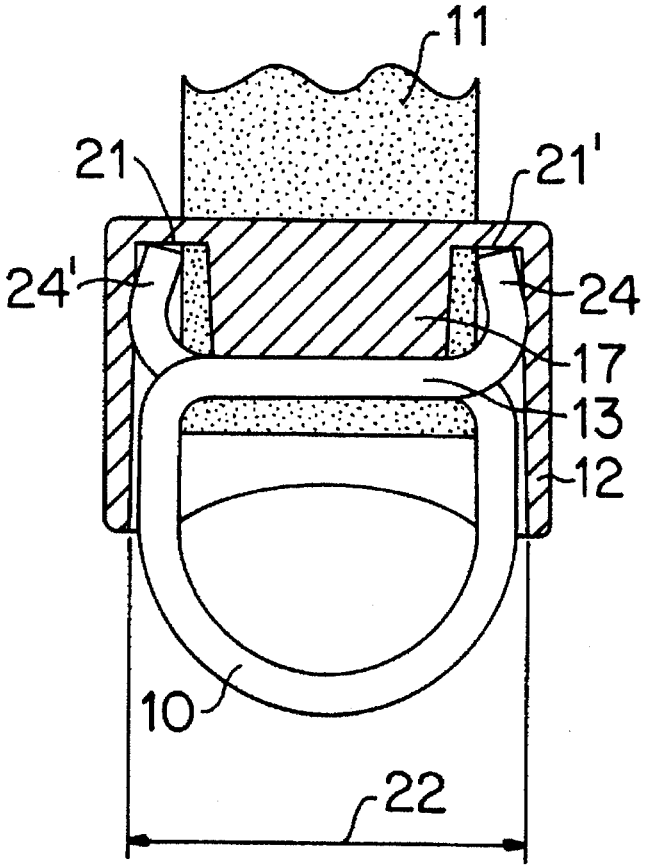
Figure 3B:
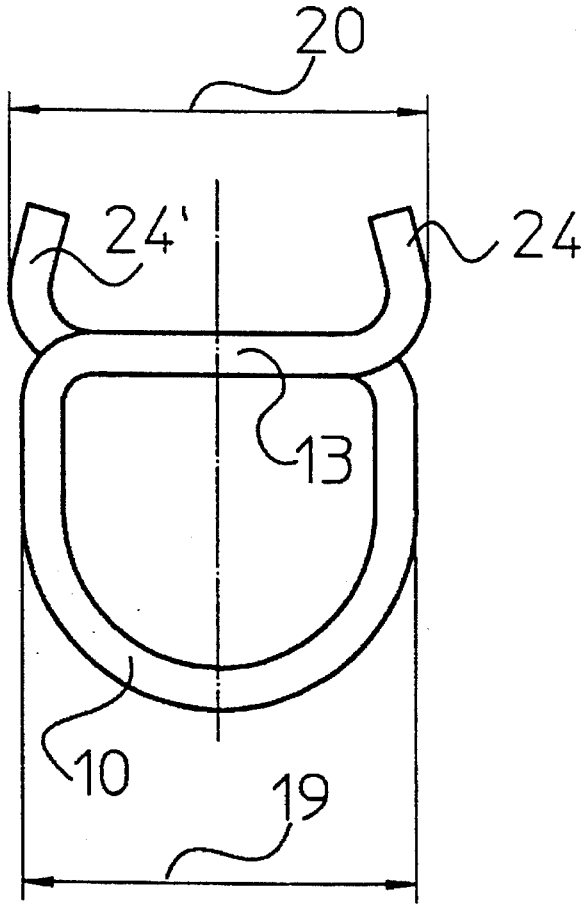

The locking element 12 is then pushed over the loop and the suspension lug 10 until the separating web 17 abuts against the legs 13, 13'. At the same time, the legs 13 of the suspension lug 10 are pressed together reducing or eliminating distance 14. As a result, unthreading is no longer possible. The overall dimension 19 of the suspension lug 10 is somewhat smaller than the outer edge 20 of the leg ends 24, 24' in the region of their angling-off. By angling off, it is meant that the legs are bent back toward the center line of the U-shape in a direction toward the upper portion of the locking element. When the leg ends are bent, they will preferably exhibit an angle less than 90 degrees with respect to their corresponding legs as shown in FIGS. 2B and 3B. Since the width of opening 22 of the combined recesses 21, 21' and separating web 17 is somewhat smaller in the angling off region than the outer edge 20 of the leg ends 24, 24', the latter are pressed together in the transverse direction when the locking element 12 is pushed on, which effects a further clamping of the locking element 12.

At the same time, the locking element 12 is secured in the region of the legs 13, 13' by one side of the carrying strap 11 protruding back into slot 23. The locking element is also secured by the conical opening 18, which is offset in a direction toward the side wall, engaging behind the loop end. This connection can be released again at any time, simply by overcoming the engaging moment. An unintentional release of the locking element 12 is not possible.

This type of fastening can be applied both for carrying straps and for carrying belts and cords and can be used for cameras, binoculars and all other products for which a detachable carrying device is required or desired. Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A combination suspension lug and locking element adapted for retaining a carrying strap, comprising:

an approximately U-shaped suspension lug, said suspension lug including an open leg located on an end of each prong of said U-shape, said open legs are bent inward at substantially right angles with respect to said prongs of said U-shape, wherein said legs face each other and are substantially parallel and coextensive for at least a portion of their respective lengths, and wherein said legs are separated by a distance, and are adapted to be retained in a loop of said carrying strap; and a locking element having an upper part, said upper part includes two substantially rectangular slot openings, with a separating web positioned therebetween, wherein said separating web is adapted to be retained in a loop of said carrying strap and said separating web is connected to side walls of said locking element, said locking element further having a lower part which includes a substantially rectangular cross-section lower opening in a bottom wall of said locking element, wherein said rectangular opening is adapted to receive the legs of the suspension lug, when said legs are retained in the loop of the carrying strap, whereby said locking element is adapted to be pushed over the loop of the carrying strap and the legs of the suspension lug to lockingly engage the carrying strap and suspension lug.

2. A combination suspension lug and locking element as claimed in claim 1, wherein said legs have leg ends, and said leg ends are configured in angle less than about 90 degrees measured from said legs, and said leg ends extend in a direction toward the loop when said suspension lug and locking element are engaging the carrying strap.

3. A combination suspension lug and locking element as claimed in claim 2, wherein the length of the transverse dimension between said leg ends is greater than an overall dimension of said suspension lug, said overall dimension being the distance between the prongs of said U-shape.

4. A combination suspension lug and locking element as claimed in claim 2, wherein the locking element further comprises recesses which are extensions of said lower opening, wherein one of said recesses is located on each side of said separating web, whereby said recesses are adapted to receive said leg ends extending in a direction toward the loop.

5. A combination suspension lug and locking element as claimed in claim 4, wherein the width of the lower opening is smaller than the length of the transverse dimension between said leg ends in order to effect a transverse clamping when said locking element is pushed over the legs of the suspension lug.

6. A combination suspension lug and locking element as claimed in claim 1, wherein said suspension lug is formed of a resilient material and an upper portion of said substantially rectangular cross-section lower opening is sufficiently narrow such that said distance is eliminated and said legs are pushed together when the locking element engages the suspension lug and the loop of the carrying strap.

7. A combination suspension lug and locking element as claimed in claim 1, wherein said legs have leg ends and the length of the transverse dimension between the leg ends is greater than an overall dimension of said suspension lug, said overall dimension being the distance between the prongs of said U-shape.

8. A combination suspension lug and locking element as claimed in claim 1, wherein said lower opening conically tapers in a direction toward the upper part of said locking element.

9. A combination suspension lug and locking element as claimed in claim 8, wherein said lower opening is offset parallel to the legs of the suspension lug in a direction toward a side wall of said locking element.

10. A combination suspension lug and locking element as claimed in claim 1, wherein the locking element further comprises a slot which is located in a side wall of the locking element which is parallel to said carrying strap, said slot is of a width which is substantially equal to the width of said carrying strap, and wherein said slot opens into said lower opening, and is adapted to receive a portion of said carrying strap which protrudes into said slot.

11. A combination suspension lug and locking element as claimed in claim 1, wherein the cross section of each of the lengths of the legs which are substantially parallel and coextensive, are circular, and the lengths of the legs are in a side-by-side configuration.

12. A combination suspension lug and locking element adapted for retaining a carrying strap, comprising:

an approximately U-shaped suspension lug, said suspension lug including an open leg located on an end of each prong of said U-shape, said open legs are bent inward at substantially right angles with respect to said prongs of said U-shape, wherein said legs face each other and are substantially parallel and coextensive for at least a portion of their respective lengths, and wherein said legs are separated by a distance, and are adapted to be retained in a loop of said carrying strap; and a locking element having an upper part, said upper part includes two substantially rectangular slot openings, with a separating web positioned therebetween, wherein said separating web is adapted to be retained in a loop of said carrying strap and said separating web is connected to side walls of said locking element, said locking element further having a lower part which includes a substantially rectangular cross-section lower opening in a bottom wall of said locking element, wherein said rectangular opening is adapted to receive the legs of the suspension lug, when said legs are retained in the loop of the carrying strap, and wherein the locking element is formed from an injection molded material, whereby said locking element is adapted to be pushed over the loop of the carrying strap and the legs of the suspension lug to lockingly engage the carrying strap and suspension lug.

13. A carrying strap securing means for securing and carrying an article, comprising:

a carrying strap having a loop;

at least one approximately U-shaped suspension lug, said suspension lug including an open leg located on an end of each prong of said U-shape, said open legs are bent inward at substantially right angles with respect to said prongs of said U-shape, wherein said legs face each other and are substantially parallel and coextensive for at least a portion of their respective lengths, and wherein said legs are separated by a distance, and are adapted to be retained in a loop of said carrying strap; and at least one locking element having an upper part, said upper part includes two substantially rectangular slot openings, with a separating web positioned therebetween, wherein said separating web is adapted to be retained in a loop of said carrying strap, said locking element further having a lower part which includes a substantially rectangular cross-section lower opening in a bottom wall of said locking element, wherein said rectangular opening is adapted to receive the legs of the suspension lug, when said legs are retained in the loop of the carrying strap, whereby said at least one locking element is adapted to be pushed over the loop of the carrying strap and the legs of the at least one suspension lug to lockingly engage the carrying strap and suspension lug.

* * * * *